US009273647B2

(12) United States Patent
Shieh et al.

(10) Patent No.: US 9,273,647 B2
(45) Date of Patent: Mar. 1, 2016

(54) AIR FILTER ASSEMBLY

(71) Applicant: Toyota Motor Engineering & Manufacturing North America, Inc., Erlanger, KY (US)

(72) Inventors: Tenghua Tom Shieh, Ann Arbor, MI (US); Dong-Hyun Lee, Ann Arbor, MI (US); Swetha Minupuri, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 156 days.

(21) Appl. No.: 14/258,702

(22) Filed: Apr. 22, 2014

(65) Prior Publication Data

US 2015/0300302 A1 Oct. 22, 2015

(51) Int. Cl.
*F02M 35/02* (2006.01)
*F02M 35/024* (2006.01)

(52) U.S. Cl.
CPC ..... *F02M 35/02425* (2013.01); *F02M 35/0201* (2013.01); *F02M 35/0216* (2013.01); *F02M 35/02491* (2013.01)

(58) Field of Classification Search
CPC ..... F02M 35/0201; F02M 35/02491; F02M 35/0212; F02M 35/0216; F02M 35/02433; F02M 35/02475; F02M 35/02466; B01D 46/02; B01D 45/00; B01D 2279/60
USPC ..... 123/198 E; 55/482
See application file for complete search history.

(56) References Cited

U.S. PATENT DOCUMENTS

| | | | | |
|---|---|---|---|---|
| 3,521,431 | A | 7/1970 | Connors et al. | |
| 5,472,463 | A | 12/1995 | Herman et al. | |
| 5,826,553 | A * | 10/1998 | Nakayama | F02M 35/04 123/184.42 |
| 6,004,382 | A | 12/1999 | Pikesh et al. | |
| 6,089,199 | A * | 7/2000 | Lohr | F02B 75/22 123/184.21 |
| 6,878,189 | B2 | 4/2005 | Moredock | |
| 7,374,593 | B2 | 5/2008 | Snyder | |
| 7,678,165 | B2 | 3/2010 | Tingle et al. | |
| 8,137,424 | B2 | 3/2012 | Ohzono | |
| 8,434,580 | B2 * | 5/2013 | Azuma | F02B 35/162 180/291 |
| 8,801,819 | B2 * | 8/2014 | Rotter | B01D 46/0004 123/198 E |
| 2013/0213235 | A1 | 8/2013 | da Silva et al. | |
| 2015/0047615 | A1 * | 2/2015 | Rollins | F02M 25/0836 123/520 |

FOREIGN PATENT DOCUMENTS

CN 203189158 U 9/2013

* cited by examiner

*Primary Examiner* — Lindsay Low
*Assistant Examiner* — Grant Moubry
(74) *Attorney, Agent, or Firm* — Dinsmore & Shohl LLP

(57) ABSTRACT

An air filter assembly for use with an internal combustion engine is provided. The air filter assembly includes a casing having an inlet configured to receive air from the environment, the casing having a passage, and an outlet disposed downstream the passage. A collection chamber collects particles from the drawn air. The collection chamber is disposed downstream from the inlet and upstream from the outlet. A partition is disposed between passage and the collection chamber. The partition has openings configured to allow particles to pass through. A side port is downstream the partition and in fluid communication with the passage. An internal combustion engine utilizing the air filter assembly is also provided. The internal combustion engine includes an air manifold, a combustion chamber and a filter. The air filter assembly is disposed upstream the filter.

20 Claims, 8 Drawing Sheets

AIR FILTER ASSEMBLY

FIELD OF THE INVENTION

The invention relates to an air filter assembly configured to remove particles from the air. More particularly, the air filter assembly includes a collection chamber downstream a passage, a partition and a side port. The partition is disposed between the passage and the collection chamber. The partition includes openings configured to allow particles to pass through. The side port is downstream the partition and disposed within the collection chamber. The side port is in fluid communication with the passage wherein air is drawn into an inlet through the passage and particles of debris are drawn into the openings of the partition so as to remove particles from the air.

BACKGROUND OF THE INVENTION

Internal combustion engines require air for generating combustion which drives reciprocating pistons. The air is introduced through an air manifold into the combustion chamber. However, in order to preserve the integrity of the combustion chamber, particulates must be filtered from the air.

Accordingly, it is known to use a filter. The filter is disposed upstream the manifold and is configured to remove fine particles from the air prior to induction into the air manifold and subsequently the combustion chamber. However, the filter creates a pressure drop and when dirtied with particulates, reduces the volume of air delivered to the combustion chamber. Thus, the pressure drop reduces the power generated by the internal combustion engine. Accordingly, such filters are replaced after a predetermined period of time.

Particles of relatively large dimension which are collected by the filter obstruct the air flow through the filter, and reduces the power generated by the internal combustion engine. In environments such as the desert where large particulates such as sand are drawn in through an inlet into the filter, the large particulates of sand may greatly decrease engine performance by clogging the filter. In such an environment, the filter will either need to be replaced or the large debris removed therefrom in order to achieve optimal engine performance. Accordingly, it remains desirable to have an air filter assembly wherein the large particulates such as sand are removed prior to the air being filtered by the filter so as to help maintain engine performance and reduce the frequency in which the filter is replaced.

SUMMARY OF THE INVENTION

According to one aspect of the invention, an air filter assembly for use in an internal combustion engine is provided. The air filter assembly includes a casing having an inlet configured to receive air from the environment. The casing includes a passage and an outlet. The outlet is disposed downstream of the passage.

The air filter assembly further includes a collection chamber configured to collect particles of debris having a predetermined dimension. The collection chamber is disposed downstream from the inlet and upstream from the outlet. The air filter assembly further includes a partition and a side port. The partition is disposed between the passage and the collection chamber. The partition includes openings configured to allow particles having a predetermined dimension to pass therethrough. The side port is disposed downstream the partition and provides fluid communication between the collection chamber and the passage.

The air filter assembly is configured to capture particles of a predetermined dimension prior to the air being filtered through a filter. Specifically, particles of debris are caught within the collection chamber by having the air drawn through the partition. The separated air is then further drawn back into the passage through the side port and continues out the outlet and fed into the filter. The partition extends between an inner wall surface of the passage and includes a plurality of openings. The openings may be dimensioned in various sizes and shapes.

The collection chamber may include a discharge port disposed on a bottom surface of the collection chamber. The discharge port may be manually opened so as to provide a passage for the release of particles caught within the collection chamber. Alternatively, the discharge port may be configured so as to automatically open and allow particles to fall therethrough.

An internal combustion engine is also provided. The internal combustion engine includes an air manifold, a combustion chamber, and a filter. The internal combustion engine further includes an air filter assembly. The manifold is configured to provide air into the combustion chamber. The filter is in fluid communication with and disposed upstream of the air manifold. The filter is configured to prevent fine particles of debris from entering into the air manifold. The air filter assembly is disposed upstream of the filter. The air filter assembly is configured to remove particles of debris larger than the particles captured by the filter.

The air filter assembly includes a casing having an inlet configured to receive fresh air from the environment. The casing includes a passage and an outlet. The outlet is disposed downstream from the passage and upstream of the filter. A collection chamber is configured to collect particles having a predetermined size. The collection chamber is disposed downstream from the inlet and upstream from the outlet.

The air filter assembly further includes a partition and a side port. The partition is disposed between the passage and the collection chamber. The partition includes a plurality of openings configured to allow particles having a dimension, shape, and size larger than the particles for which the filter is designed to capture.

The side port provides fluid communication between the collection chamber and the passage. The side port is downstream the partition wherein air is drawn into the inlet through the passage and through the partition wherein the particles of debris are drawn into the openings of the partition and collected within the collection chamber. The separated air is further drawn through the side port and back into the passage and through the outlet into the filter.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Figure 9:
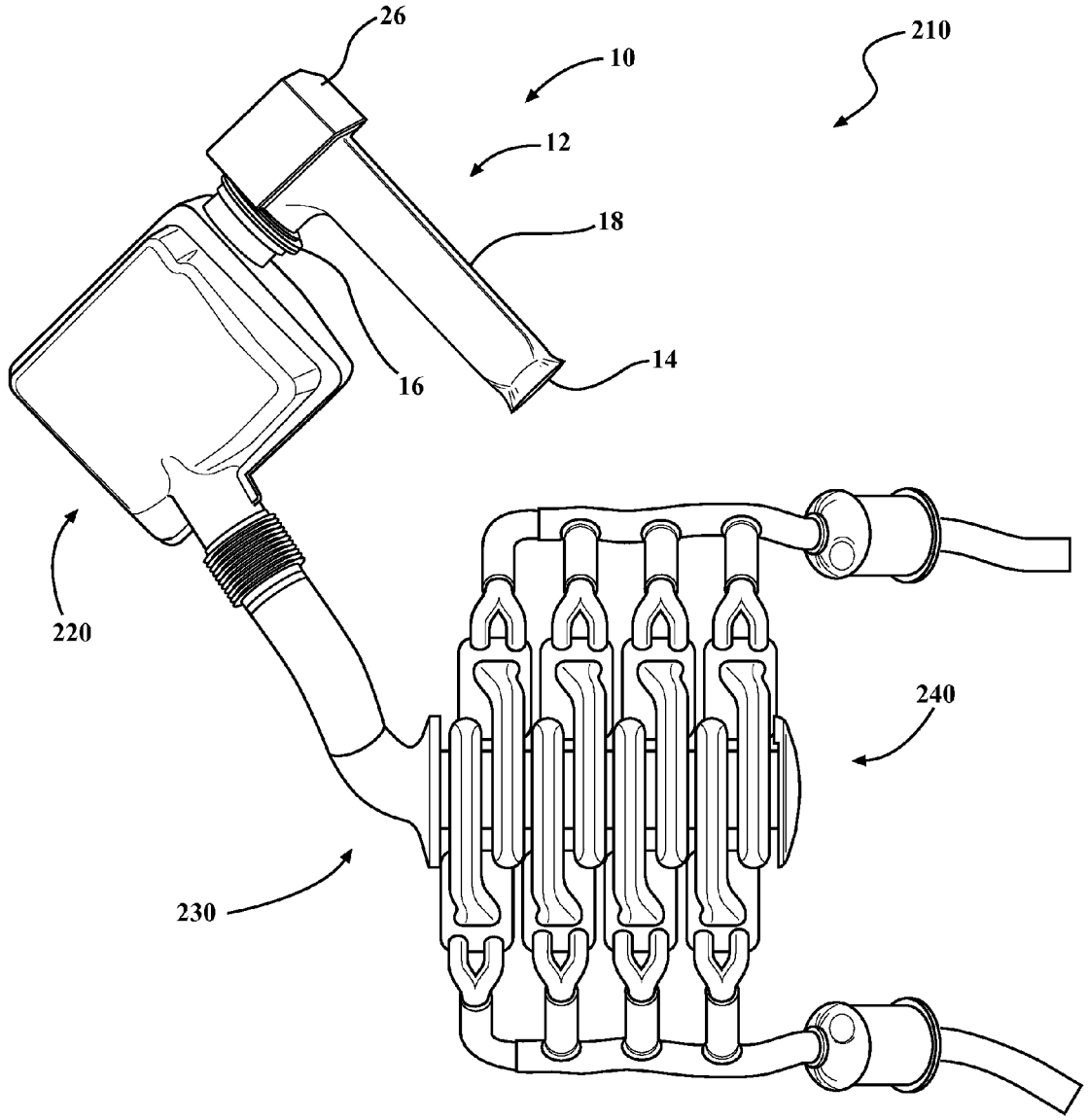
FIG. 9 is a perspective view of an internal combustion engine having an air filter assembly.

With reference now to FIGS. 1-4, a first preferred embodiment of the air filter assembly 10 is provided. The air filter assembly 10 may be used with an internal combustion engine 210 (shown in FIG. 9). The air filter assembly 10 is configured to remove particulates from the air prior to air being filtered from a filter 220 so as to prevent a large pressure drop between the filter 220 and an air manifold 230, and the frequency of service calls to clean the filter 220. An exemplary illustration of the internal combustion engine 210 and the filter 220 is shown in FIG. 9. Accordingly, power performance of the internal combustion engine 210 is optimized.

The air filter assembly 10 includes a casing 12. The casing 12 may be formed out of a generally rigid and durable material such as a hardened plastic polymer or a metal. The casing 12 includes an inlet 14, an outlet 16 and a passage 18 fluidly connecting the inlet 14 to the outlet 16. The inlet 14 is configured to receive fresh air from the environment. The inlet 14 includes an opening 14*a* which may be aligned along a vertical plane when the casing 12 is mounted to the internal combustion engine 210.

Figure 1:
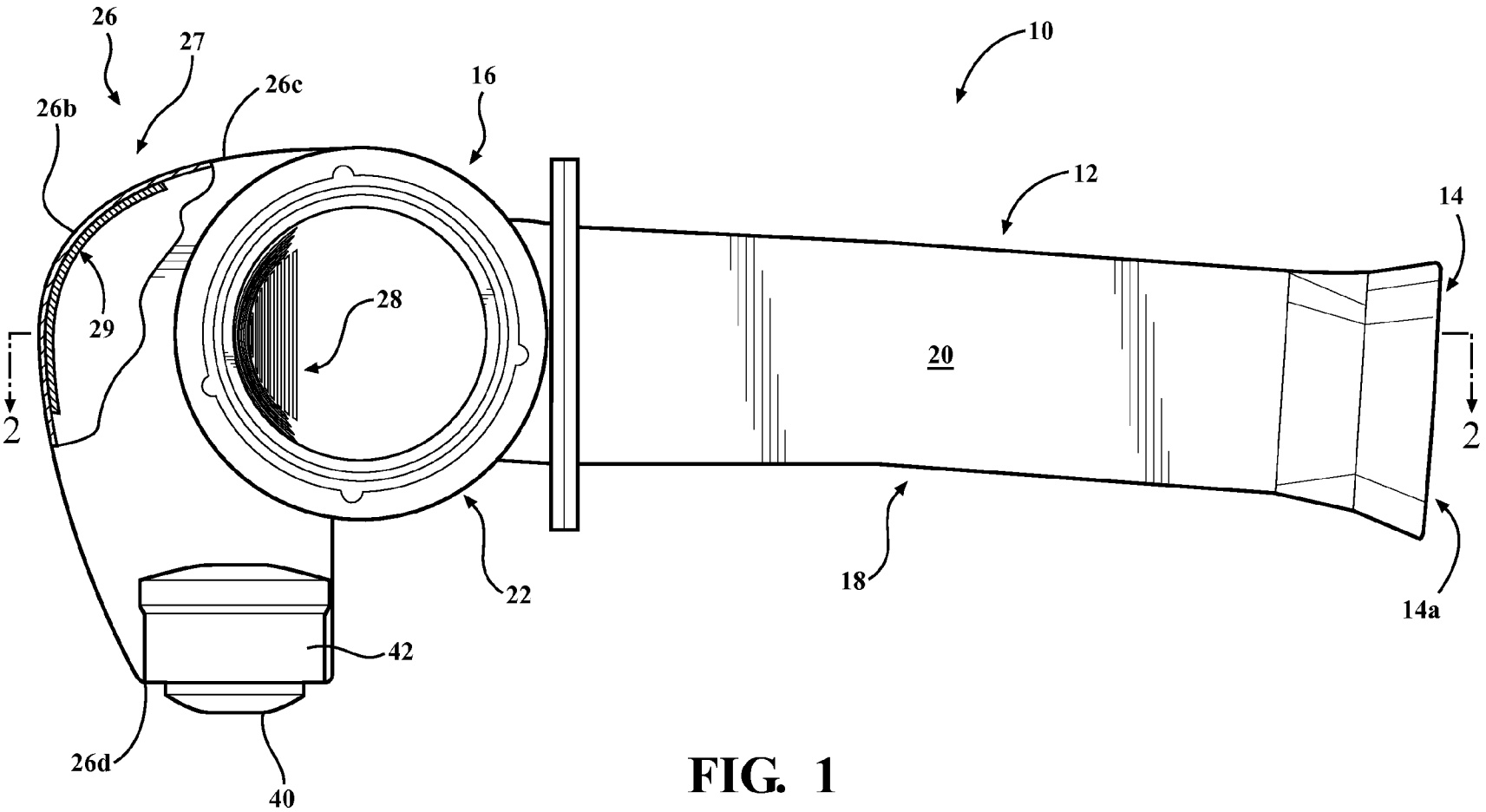
FIG. 1 is a view of the air filter assembly showing the opening of the outlet.
Figure 5:
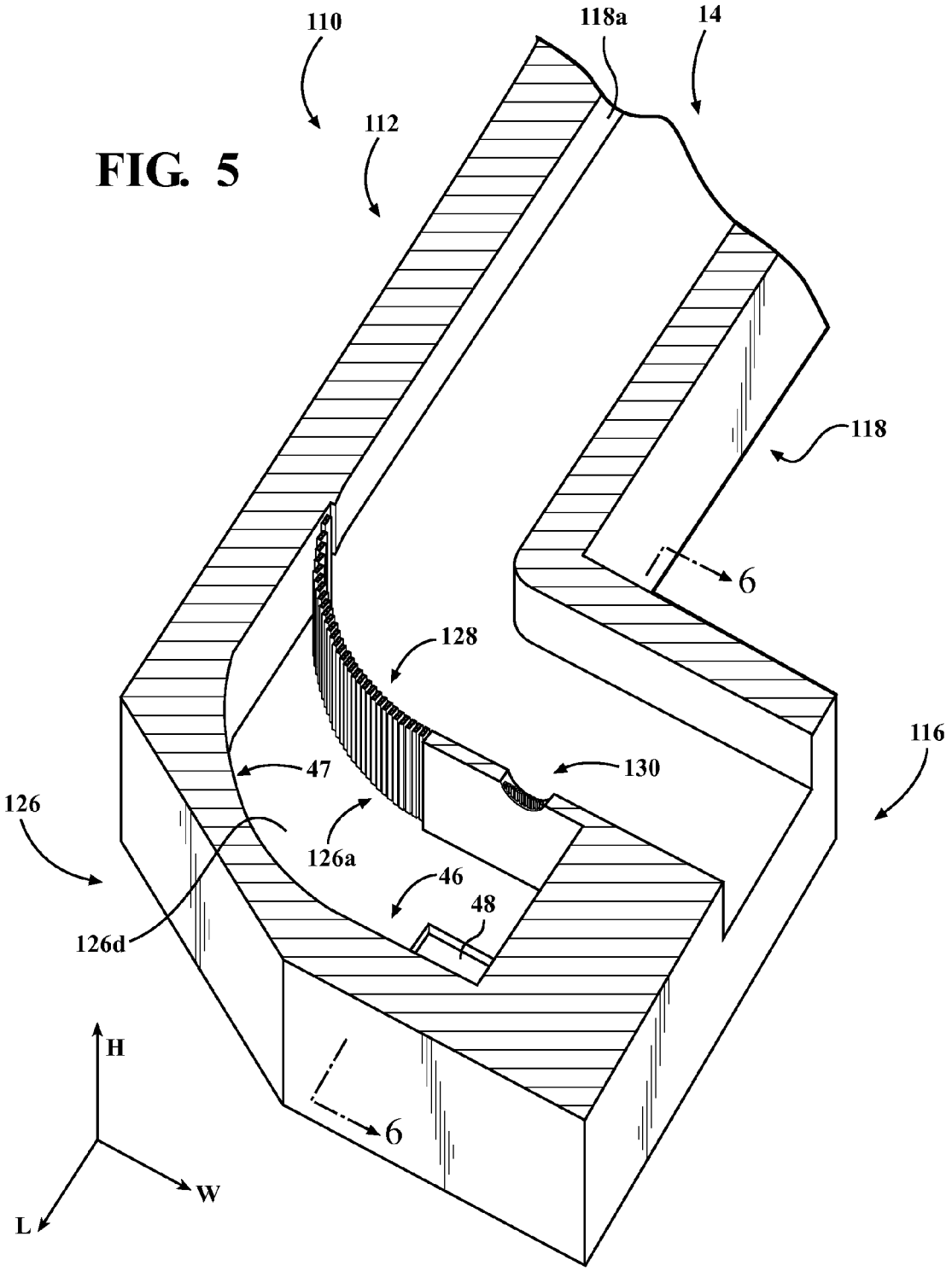
FIG. 5 is a perspective view of a second preferred embodiment of an air filter assembly with a section of the collection chamber removed.

The outlet 16 is disposed downstream the passage 18. The passage 18 interconnects the inlet 14 with the outlet 16. The passage 18 is a tubular structure having an inner wall surface 18*a*. The passage 18 may have a generally rectangular cross-section as shown in FIGS. 1 and 5. However, it should be appreciated that the passage 18 may have a cross-section dimensioned otherwise, such as circular. The passage 18 is shown disposed along a generally horizontal plane, but it should be appreciated that the passage 18 may bend to accommodate packaging constraints of the engine compartment. For illustrative purposes the passage 18 is shown having a first portion 20 and a second portion 22. The first portion 20 has a generally rectangular cross section, and the second portion has generally circular cross section. Both the first and second portions 20, 22 extend along an axis each of which are generally orthogonal to each other, so as to form a bend 24. The first and second portion 20, 22 of the passage 18 are disposed along a generally horizontal plane.

The air filter assembly 10 further includes a collection chamber 26, a partition 28 and a side port 30. The collection chamber 26 is separated from the passage 18 by the partition 28. The collection chamber 26 is configured to collect particles of debris which are filtered by the partition 28. The collection chamber 26 is disposed downstream from the inlet 14 and upstream from the outlet 16.

The partition 28 is disposed between the passage 18 and the collection chamber 26. The partition 28 covers the side opening 26*a* of the collection chamber 26. The partition 28 includes a plurality of openings 34 configured to allow particles to pass through. The openings 34 are dimensioned to allow particles of debris to pass having a volumetric size greater than 100 microns.

Figure 3:
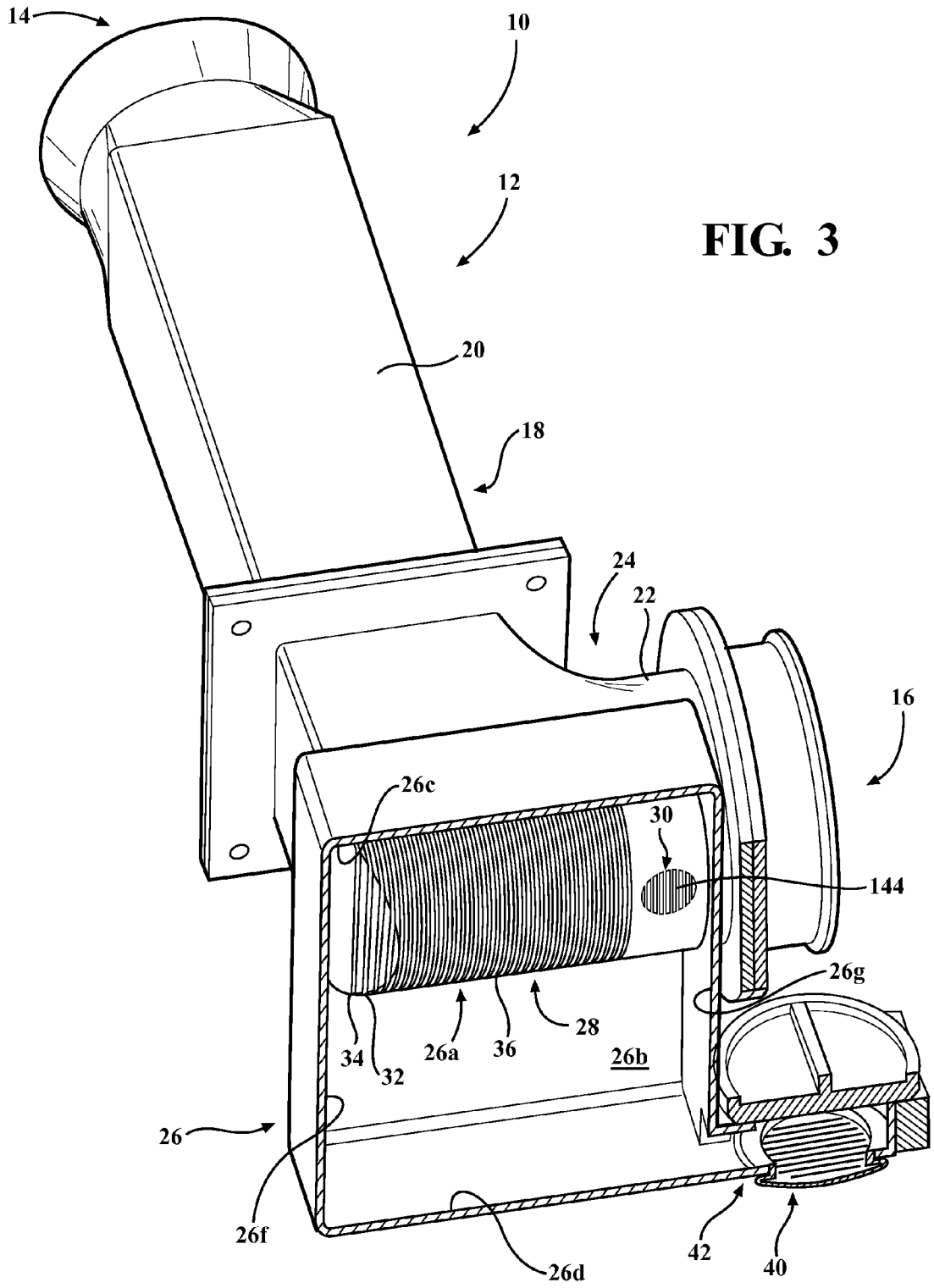
FIG. 3 is a cross-sectional view of FIG. 2 taken along lines 3-3.
Figure 4:
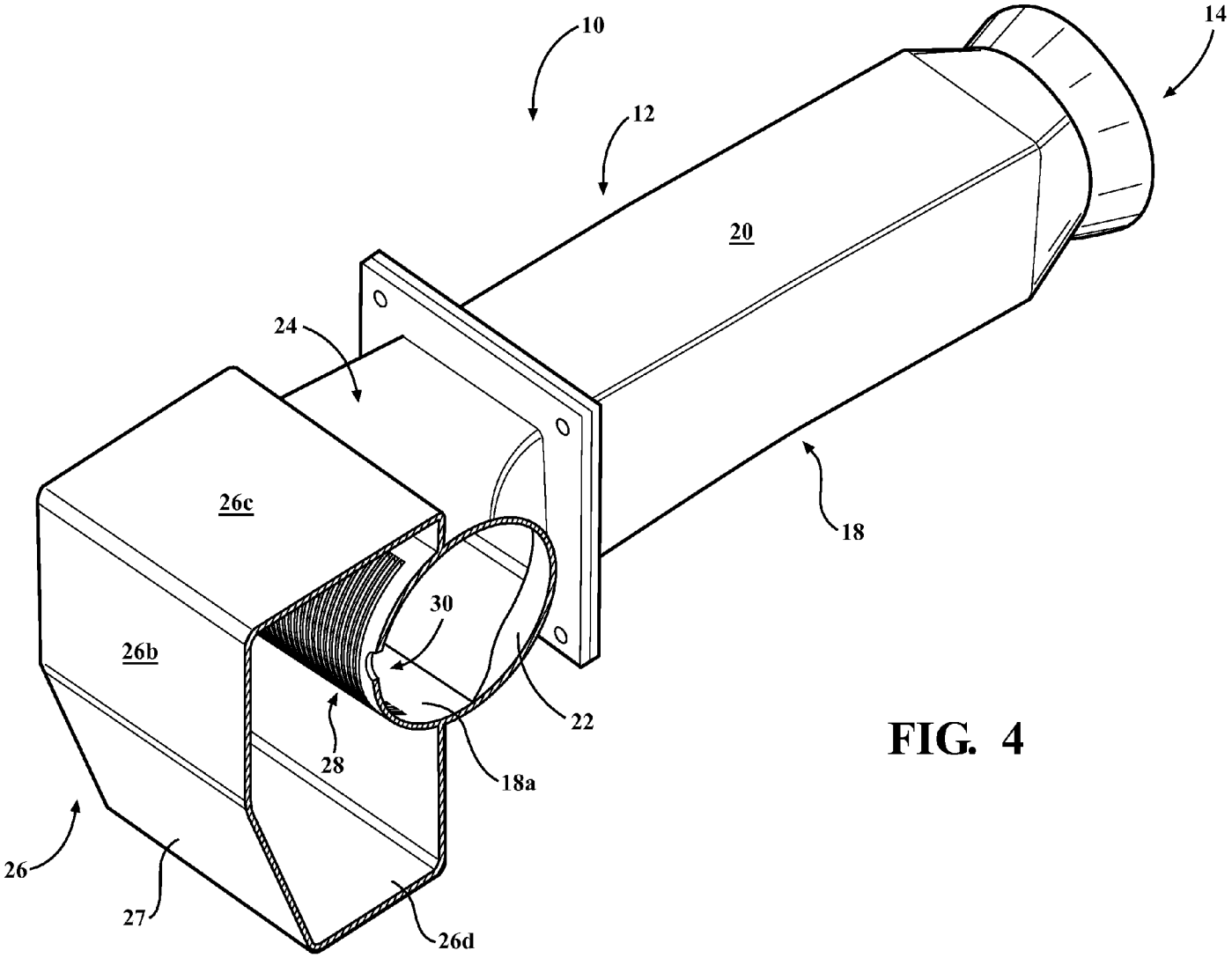
FIG. 4 is a perspective view of the air filter assembly with a portion of the collection chamber removed.

The partition 28 extends between the inner wall surface 18*a* of the passage 18 and defines a boundary between the passage 18 and the collection chamber 26. The partition 28 may have an arcuate profile. The partition 28 may include a plurality of panels 32. An illustrative embodiment of the partition 28 is provided wherein the panels 32 of the partition 28 have a semi-circular dimension, as shown in FIGS. 3 and 4. Each panel 32 is spaced apart from the other so as to form the openings 34. In a preferred embodiment, the openings take the form of slits 36. The slits 36 extend between the opposing side of the inner wall surface 18*a*. However, it should be appreciated that the openings 34 may have a different shape, such as square, circular or rectangular.

The collection chamber 26 encloses a space separate from the passage 18, and collects particles of debris which are passed through the partition 28. The collection chamber 26 has a side opening 26*a* upstream from the side port 30. The side opening 26*a* is in direct fluid communication with the passage 18 and is axially aligned with an elongated portion of the passage 18. Thus, particles of debris are thrust though the partition 28, the side opening 26*a* and into the collection chamber 26.

The collection chamber 26 may further include a back wall 26*b*, a top wall 26*c*, a bottom wall 26*d*, a front wall 26*e* and a pair of spaced apart side walls 26*f*, 26*g* defining a first chamber portion 38. As shown in FIGS. 1 and 4, the back wall 26*b* may be curved 27 so as to deflect particles passing through the partition 28 downwardly towards the bottom wall 26*d*. With reference now to FIG. 1, the back wall 26*d* may be covered by a sheet 29. The sheet 29 covers the curved portion 27, or a surface in which particles are directed past the partition 28. The sheet 29 is configured to absorb the energy from the impacting particles so as to help retain the particles within the collection chamber 26. With reference again to FIGS. 1 and 4, a bottom portion of the back wall 27 slanted or curved forming a slide leading towards the bottom wall 26*d*.

The collection chamber includes a discharge port 40 configured to allow particles within the debris to exit into the environment. In the first preferred embodiment, the discharge port 40 is disposed on the bottom wall 26*d* of the collection chamber 26. Specifically, the discharge port 40 is disposed within a side chamber 42 of the collection chamber 26. The slanted portion 27 of the back wall 26*b* feeds particles of debris into the discharge port 40.

In one embodiment, the discharge port 40 is configured to automatically release particles which are caught within the collection chamber 26. For instance, the discharge port 40 may be formed of a generally resilient member such as a rubber piece. The rubber piece may include a plurality of slits which are operable to open upon vibration so as to allow particles of debris such as sand to fall therethrough using gravity assist. Thus, particles collected within the collection chamber 26 hit the back wall 26*b* and slide along the slanted portion towards the discharge port 40.

In operation, air in the collection chamber 26 is drawn through the first portion 20 of the passage 18, and particles of debris dimensioned to fit through the partition 28 are collected in the collection chamber 26. The particles of air are drawn into the partition 28 by the momentum of the particles, the remaining fresh air is drawn along the bend down the second portion 22. Air within the collection chamber is drawn into the second portion 22 through the side port 30. A screen 44 may be mounted over the side port 30 to further prevent particles of debris having an undesired dimension from leaving the outlet 16. The side port 30 is downstream the partition 28 and facilitates air flow through the partition 28 by providing a vent for which air in the collection chamber 26 may pass.

The air and particles held therein may passes through the side port 30, wherein additional particles may be prevented from passing past the screen 44, while simultaneously assist with air flow.

With reference now to FIGS. 5-9, a second preferred embodiment of the air filter assembly 10 is provided wherein like references are indicated by the same reference numbers increased by 100. In the second preferred embodiment, the passage 118 has a generally uniform rectangular cross section. The first portion 120 is orthogonal to the second portion 122.

The partition 128 has a cross section which is generally half a semicircle. The back wall 126*b* of the collection chamber 126 includes a top portion 47 and a bottom portion 48. The top portion 47 of the back wall follows a shape which is similar to that of the partition 128. The front wall 126*e* of the collection chamber 126 includes a side port 130 which is disposed downstream from the partition 128.

Figure 6:
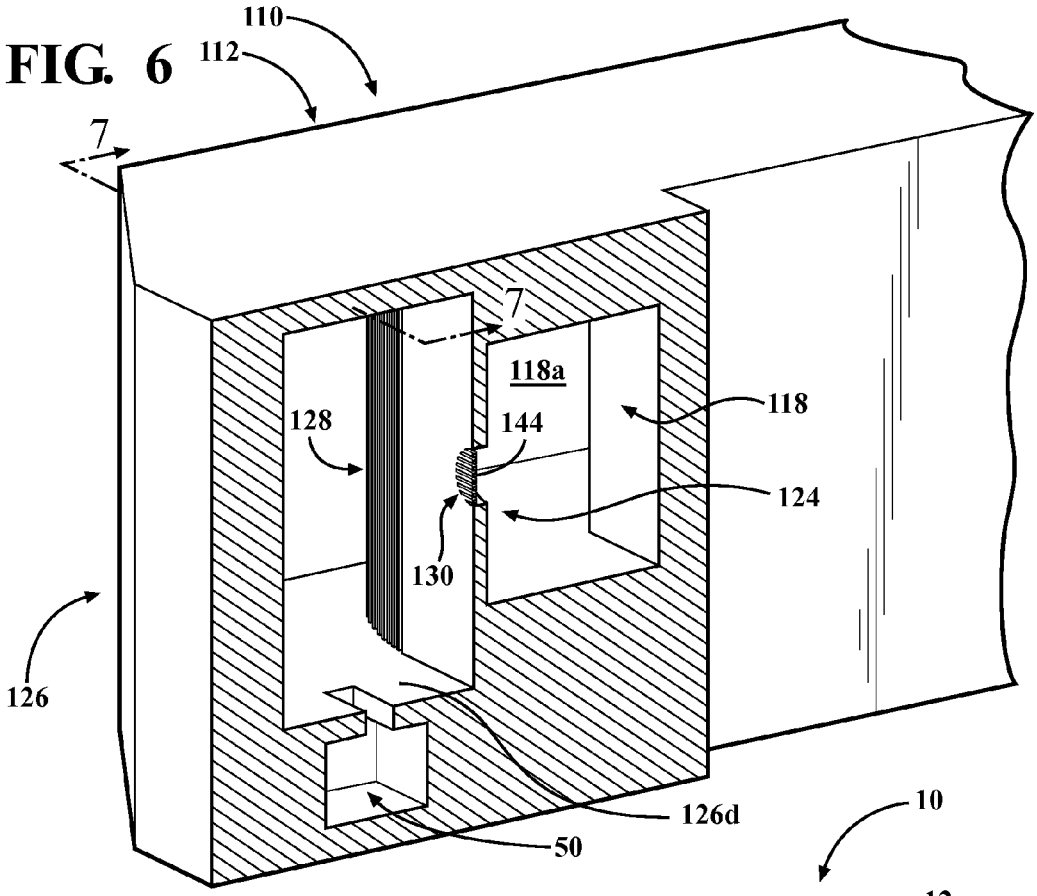
FIG. 6 is a cross-sectional view of the air filter assembly of FIG. 5 taken along line 6-6.
Figure 7:
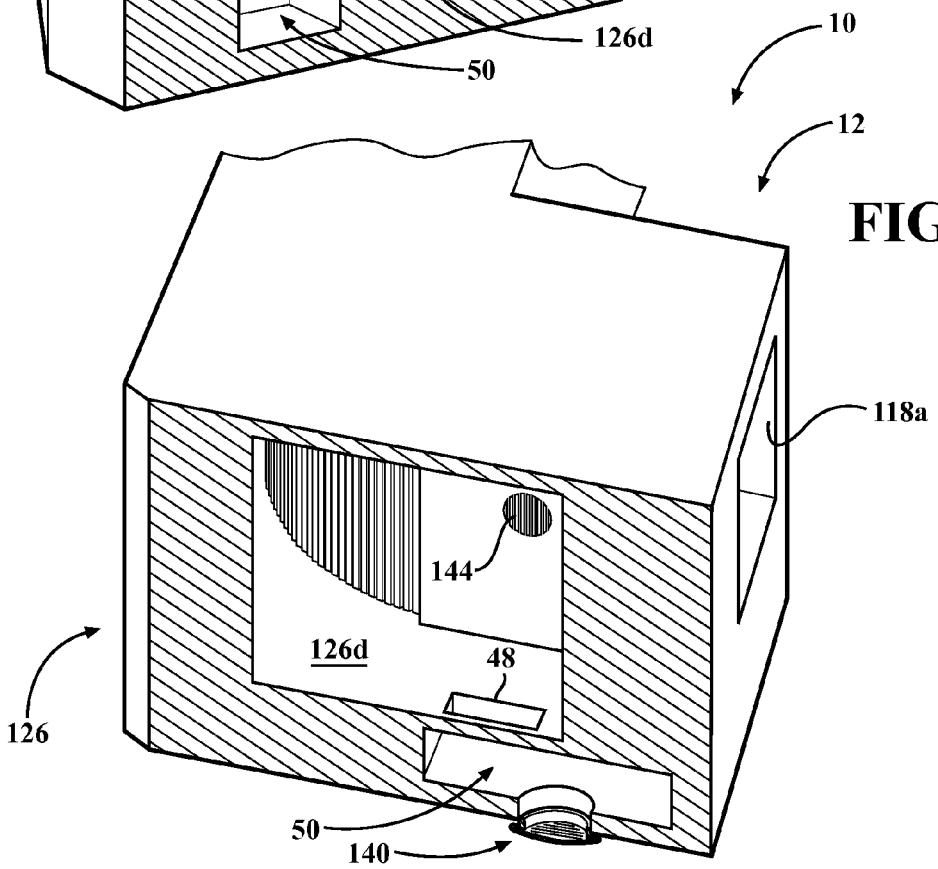
FIG. 7 is a cross-sectional view of the air filter assembly of FIG. 6 taken along line 7-7.
Figure 8:
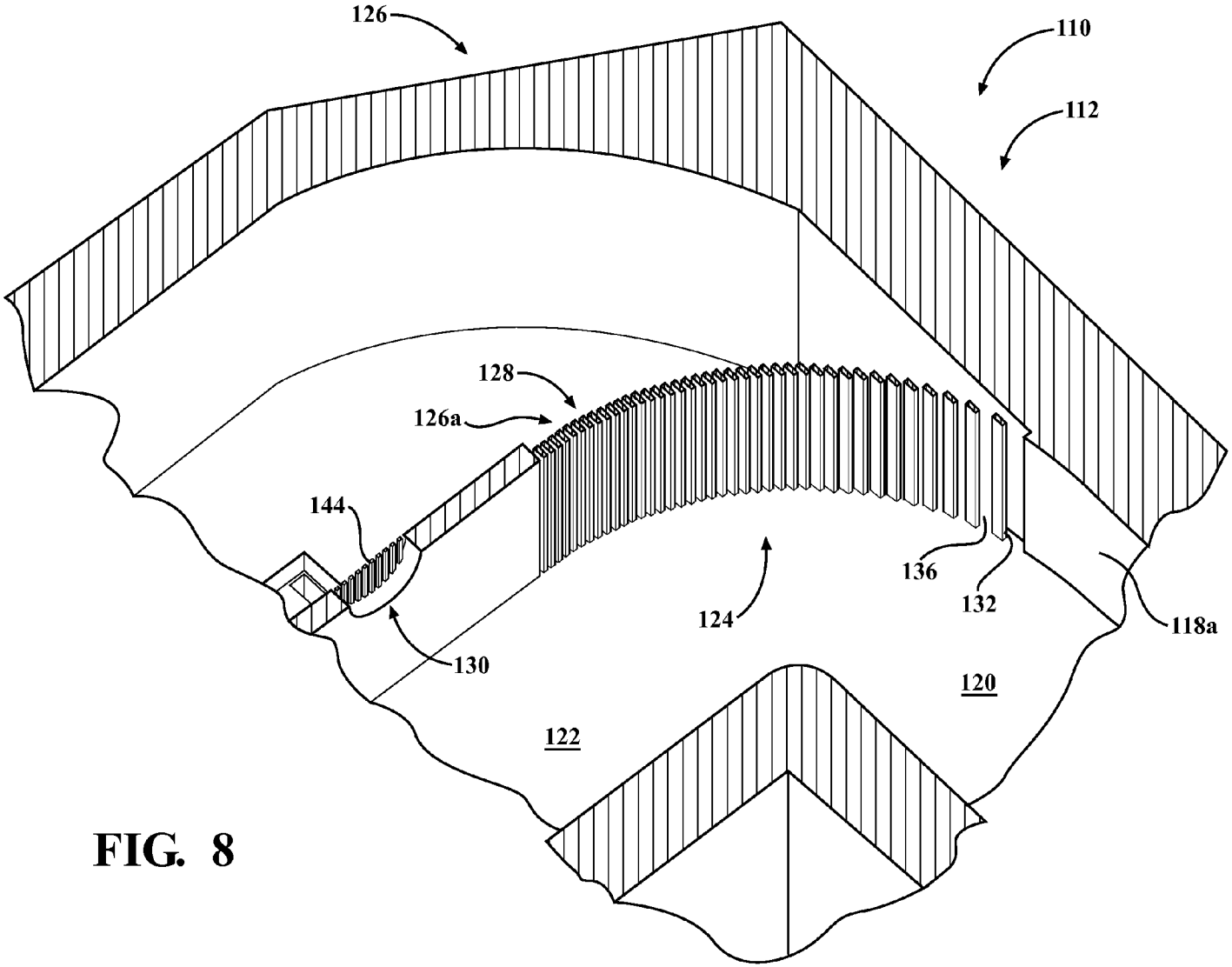
FIG. 8 is a focused view of FIG. 5 showing an embodiment of the partition.

As shown in FIG. 5, the collection chamber 126 includes a first opening 48 disposed on the bottom wall 126*d*. An ancillary housing 50 is beneath the bottom wall 126*d*. The first opening 48 interconnects the collection chamber 126 with the ancillary housing 50, as shown in FIGS. 6 and 7. The discharge port 140 is disposed in the ancillary housing 50. As discussed above, the discharge port 140 is configured to allow particles of debris to fall into the environment. As above, the discharge port 140 may release particles automatically, wherein the discharge port 140 is formed of a generally resilient member such as a rubber piece. The rubber piece may include a plurality of slits 141 which are operable to open upon vibration so as to allow particles of debris such as sand to fall therethrough using gravity assist. In another embodiment, not shown, the discharge port 140 may include a removable cover such as a threaded cap which may be screwed on or off the ancillary housing 50.

With reference now to FIG. 9, an internal combustion engine 210 is provided. The internal combustion engine 210 includes an air manifold 230, combustion chamber 240, a filter 220 and an air filter assembly 10. The air manifold 230 is configured to provide air into the combustion chamber 240. The air manifold 230 is upstream of the combustion chamber 240, and the filter 220 is upstream of the air manifold 230 and downstream from the air filter assembly 10.

Any filter 220 currently known and used in the art may be adaptable for use herein. Such filters 220 may be donut shaped or block shaped, and are disposed upstream of the air manifold 230. Filters 220 are designed based upon the combustion chamber 240 capacity. A filter 220 for a V8 internal combustion engine 210 may be block shaped and configured to filter particle and debris. Thus it should be appreciated that the partition 28 may include openings 34 configured to compliment the filter 220 that the partition 28 is upstream of. For example, the openings 34 may be configured to allow particles and debris having a volumetric size greater than 10 microns to pass through when used with a 5.7 liter v8 internal combustion engine 210.

The air filter assembly 10 is configured to remove particulates from the air prior to air being filtered from a filter 220 so as to prevent a large pressure drop between the filter 220 and an air manifold 230. An air filter assembly as illustratively described herein may be used in the internal combustion engine 210. Accordingly, power performance of the internal combustion engine 210 is optimized.

The air filter assembly 10 includes a casing 12. The casing 12 may be formed out of a generally rigid and durable material such as a hardened plastic polymer or a metal. The casing 12 includes an inlet 14, an outlet 16 and a passage 18 fluidly connecting the inlet 14 to the outlet 16. The inlet 14 is configured to receive fresh air from the environment. The inlet 14 includes an opening 14*a* which may be aligned along a vertical plane when the casing 12 is mounted to the internal combustion engine 210. The outlet 16 is disposed downstream the passage 18. The passage 18 interconnects the inlet 14 with the outlet 16. The outlet 16 is upstream the filter 220 and is in fluid communication with the filter 220.

The passage 18 is a tubular structure having an inner wall surface 18*a*. The passage 18 may have a generally rectangular cross-section as shown in FIGS. 1 and 5. However, it should be appreciated that the passage 18 may have across-section dimensioned otherwise, such as circular. The passage 18 is shown disposed along a generally horizontal plane, but it should be appreciated that the passage 18 may bend to accommodate packaging constraints of the engine compartment.

The air filter assembly 10 further includes a collection chamber 26, a partition 28 and a side port 30. The collection chamber 26 is separated from the passage 18 by the partition 28. The collection chamber 26 is configured to collect particles of debris which are filtered by the partition 28. The collection chamber 26 is disposed downstream from the inlet 14 and upstream from the outlet 16.

The partition 28 is disposed between the passage 18 and the collection chamber 26. The partition 28 covers the side opening 26*a* of the collection chamber 26. The partition 28 includes a plurality of openings 34 configured to allow particles to pass through. The openings 34 are dimensioned to allow particles of debris having a volumetric size greater than 100 microns.

The partition 28 extends between the inner wall surface 18*a* of the passage 18 and defines a boundary between the passage 18 and the collection chamber 26. The partition 28 may have an arcuate profile. The partition 28 may include a plurality of panels 32. An illustrative embodiment of the partition 28 is provided wherein the panels 32 of the partition 28 has a semi-circular dimension, as shown in FIGS. 3 and 4. Each panel 30 is spaced apart from the other so as to form the openings 34. In a preferred embodiment, the openings take the form of slits 36. The slits 34 extend between the opposing side of the inner wall surface 18*a*. However, it should be appreciated that the openings 34 may have a different shape, such as square, circular or rectangular.

The collection chamber 26 encloses a space separate from the passage 18, and collects particles of debris which are passed through the partition 28. The collection chamber 26 has a side opening 26*a* upstream from the side port 30. The side opening 26*a* is in direct fluid communication with the passage 18 and is axially aligned with an elongated portion of the passage 18. Thus, particles of debris are thrust though the partition 28, the side opening 26*a* and into the collection chamber 26.

Figure 2:
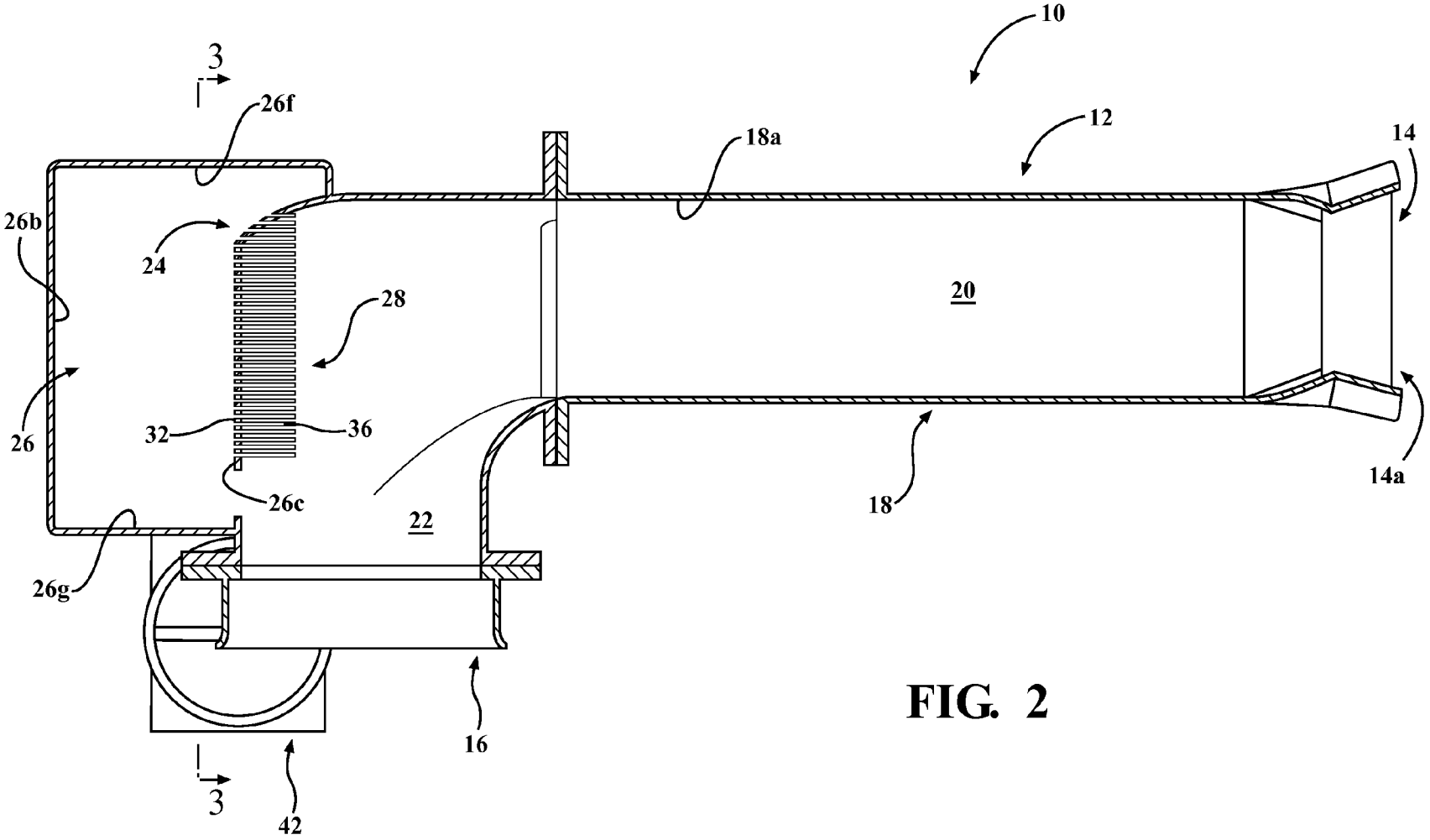
FIG. 2 is a cross-sectional view of FIG. 1 taken along lines 2-2.

The collection chamber 26 may further include a back wall 26*b*, a top wall 26*c*, a bottom wall 26*d*, a front wall 26*e* and a pair of spaced apart side walls 26*f*, 26*g* defining a first chamber portion 38. As shown in FIG. 2, a bottom portion of the back wall 26*b* is slanted forming a slide leading towards the bottom wall 26*d*.

The collection chamber includes a discharge port 40 configured to allow particles within the debris to exit into the environment. In the first preferred embodiment, the discharge port 40 is disposed on the bottom wall 26*d* of the collection chamber. Specifically, the discharge port 40 is disposed within a side chamber 46 of the collection chamber 26. The slanted portion of the back wall 26*b* feeds particles of debris into the discharge port 40.

In one embodiment, the discharge port 40 is configured to automatically release particles which are caught within the collection chamber 26. For instance, the discharge port 40 may be formed of a generally resilient member such as a rubber piece. The rubber piece may include a plurality of slits which are operable to open upon vibration so as to allow particles of debris such as sand to fall therethrough using gravity assist. Thus, particles collected within the collection chamber 26 hit the back wall 26*b* and slide along the slanted portion towards the discharge port 40.

In operation, the internal combustion engine 210 draws fresh air through the intake. The air is further drawn through the passage. As air travels along the first portion 20 of the passage 18, particles of debris dimensioned to fit through the partition 28 are collected in the collection chamber 26. The particles of air are drawn into the partition 28 by the momentum of the particles, the remaining fresh air is drawn along the bend down the second portion 22. Air within the collection chamber 26 is drawn into the second portion 22 through the side port 30. The air is blended with the air in the second portion 22 and fed into the filter 220, which further filters the air before being introduced into the air manifold 230. Thus, the filtered air is provided in the combustion chamber 240. Accordingly, the air filter assembly 10 is configured to prevent particles of debris having a predetermined dimension from being caught in the filter 220, thus maintaining a desired pressure drop from the filter 220 and the manifold 230.

Obviously, many modifications and variations of the present invention are possible in light of the above teachings and may be practiced otherwise than as specifically described while within the scope of the appended claims.

The invention claimed is:

1. An air filter assembly, the air filter assembly comprising:

a casing having an inlet configured to receive air from the environment, the casing having a passage, and an outlet disposed downstream the passage;

a collection chamber configured to collect particles, the collection chamber disposed downstream from the inlet and upstream from the outlet; and a partition and a side port, the partition disposed between the passage and the collection chamber, the partition having openings configured to allow particles to pass through, the side port is downstream the partition and in fluid communication with the passage, wherein air is drawn into the inlet, through the passage and particles of debris are drawn into the openings, the separated air is further drawn through the side port and back into the passage.

2. The air filter assembly as set forth in claim 1, wherein the partition has an arcuate profile.

3. The air filter assembly as set forth in claim 1, wherein the partition includes a plurality of panels, each of the plurality of panels spaced apart from each other so as to form the openings, wherein the openings are slits.

4. The air filter assembly as set forth in claim 3, wherein the passage includes an inner wall surface, each of the slits extending between the opposing sides of the inner wall surface the passage.

5. The air filter assembly as set forth in claim 3, wherein each of the plurality of panels are spaced evenly apart from each other along an arcuate profile.

6. The air filter assembly as set forth in claim 1, further including a screen, the screen mounted over the side port.

7. The air filter assembly as set forth in claim 1, wherein the collecting chamber includes a back wall, a top wall, a bottom wall and a front wall, a portion of the back wall having an arcuate profile similar to the partition.

8. The air filter assembly as set forth in claim 1, further including a discharge port, the discharge port disposed in the collection chamber, the discharge port having a first cover so as to provide a passage to release particles caught within the collection chamber.

9. The air filter assembly as set forth in claim 1, further including a second chamber, the second chamber in fluid communication with the collection chamber, the second chamber having an outlet, the outlet having a second cover so as to provide a passage to release particles collected therein.

10. The air filter assembly as set forth in claim 1, wherein the passage includes a first portion and a second portion, the first portion extends along a first axis and the second portion extends along a second axis and is generally orthogonal to the first portion.

11. An internal combustion engine having an air manifold, a combustion chamber, a filter, and an air filter assembly, the manifold configured to provide air into the combustion chamber, the filter in fluid communication with the air manifold and configured to filter particles of debris, and the air filter assembly disposed upstream the filter, characterized in that the air filter assembly comprising:

a casing having an inlet configured to receive air from the environment, the casing having a passage, and an outlet disposed downstream the passage and upstream the filter;

a collection chamber configured to collect particles, the collection chamber disposed downstream from the inlet and upstream from the outlet; and a partition and a side port, the partition disposed between the passage and the collection chamber, the partition having openings configured to allow particles to pass through, the side port is downstream the partition and in fluid communication with the passage, wherein air is drawn into the inlet, through the passage and particles of debris are drawn into the openings, the separated air is further drawn through the side port and back into the passage and into the filter.

12. The air filter assembly as set forth in claim 11, wherein the partition has an arcuate profile.

13. The air filter assembly as set forth in claim 11, wherein the partition includes a plurality of panels, each of the plurality of panels spaced apart from each other so as to form the openings, wherein the openings are slits.

14. The air filter assembly as set forth in claim 13, wherein the passage includes an inner wall surface, each of the slits extending between the opposing sides of the inner wall surface of the passage.

15. The air filter assembly as set forth in claim 14, wherein each of the plurality of panels are spaced evenly apart from each other along an arcuate profile.

16. The air filter assembly as set forth in claim 11, further including a screen, the screen mounted over the side port.

17. The air filter assembly as set forth in claim 11, wherein the collecting chamber includes a back wall, a top wall, a bottom wall and a front wall, a portion of the back wall having an arcuate profile similar to the partition.

18. The air filter assembly as set forth in claim 11, further including a discharge port, the discharge port disposed in the collection chamber, the discharge port having a first cover so as to provide a passage to release particles caught within the collection chamber.

19. The air filter assembly as set forth in claim 11, further including a second chamber, the second chamber in fluid communication with the collection chamber, the second chamber having an outlet, the outlet having a second cover so as to provide a passage to release particles collected therein.

20. The air filter assembly as set forth in claim 11, wherein the passage includes a first portion and a second portion, the first portion extends along a first axis and the second portion extends along a second axis and is generally orthogonal to the first portion.

* * * * *